US006201177B1

(12) United States Patent
Ito

(10) Patent No.: US 6,201,177 B1
(45) Date of Patent: Mar. 13, 2001

(54) MUSIC APPARATUS WITH AUTOMATIC PITCH ARRANGEMENT FOR PERFORMANCE MODE

(75) Inventor: Shinichi Ito, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/511,523

(22) Filed: Feb. 23, 2000

(30) Foreign Application Priority Data

Mar. 2, 1999 (JP) ..... 11-54420

(51) Int. Cl.[7] ..... G10H 1/36; G10H 7/00

(52) U.S. Cl. ..... 84/610; 84/613; 431/307 A

(58) Field of Search ..... 84/610, 634, 650, 84/613, 637; 434/307 A

(56) References Cited

U.S. PATENT DOCUMENTS

| | | | | |
|---|---|---|---|---|
| 5,719,346 | * | 2/1998 | Yoshida et al. . | |
| 5,739,452 | * | 4/1998 | Nagata | 84/610 |
| 5,770,813 | * | 6/1998 | Nakamura | 84/610 |
| 5,857,171 | * | 1/1999 | Kageyama et al. | 84/610 X |
| 5,902,951 | * | 5/1999 | Kondo et al. | 84/610 |
| 5,939,654 | * | 8/1999 | Anada | 84/610 |

* cited by examiner

*Primary Examiner*—Jeffrey Donels
(74) *Attorney, Agent, or Firm*—Morrison & Foerster

(57) ABSTRACT

A music apparatus is constructed for playing a music under different performance modes with processing of a voice signal according to a performance signal. In the music apparatus, an input section provides the voice signal representative of a music sound and the performance signal indicative of how to process the voice signal in synchronization to the playing of the music. An identifying section identifies a current performance mode under which the music is played. A processing section processes the voice signal in accordance with the performance signal to determine a pitch of the music sound so as to adapt the pitch to the current performance mode. In practice, the identifying section discriminates between a style performance mode which turns on an automatic accompaniment of the music and a song performance mode which turns off the automatic accompaniment. The processing section operates when the identifying section identifies that the current performance mode is the style performance mode for processing the voice signal to create a chordal harmony of the music sound in matching with the automatic accompaniment, and otherwise operates when the identifying section identifies that the current performance mode is the song performance mode for processing the voice signal to create a vocoder harmony of the music sound.

17 Claims, 6 Drawing Sheets

MUSIC APPARATUS WITH AUTOMATIC PITCH ARRANGEMENT FOR PERFORMANCE MODE

BACKGROUND OF THE INVENTION

1. Field of the Invention

The present invention relates generally to a music apparatus for performing acoustic processing on externally supplied voice signals according to predetermined command information. More specifically, the present invention relates to a music apparatus capable of automatically switching to an adapted harmony type in the music apparatus having a capability of generating harmony voices on the basis of voice signal and chord signal.

2. Description of Related Art

Music apparatuses are known having an effect imparting capability of generating harmony voices on the basis of a voice signal and chord signal for the effect processing to be performed on a music piece. These music apparatuses provide a harmony type called "vocoder harmony" in which, when a voice is inputted and a keyboard is played, a harmony voice is generated at a pitch specified by the keyboard, and another harmony type called "chordal harmony" in which a chord played by the keyboard is detected to impart harmony voices having pitches of constituent notes of that chord. These harmony types are generically referred to as vocal harmonies.

On the other hand, music apparatuses are known having a capability of switching between a performance mode called "style mode" in which a keyboard play is executed by use of an automatic accompaniment capability for sounding accompaniment sounds based on automatic accompaniment data, and another performance mode called "song mode" that permits keyboard play while sounding tones based on song data recorded in advance.

When performing a music by use of the automatic accompaniment capability, chord specification permits automatic performance of an accompaniment suited to the specified chord. In this case, for a music apparatus having a harmony voice generating capability, the chordal mode is optimum for the harmony of music performance. Therefore, when switching the setting from the state where the song mode is set to the other state where the automatic accompaniment mode is adopted, the vocal harmony should be also switched to the chordal mode.

On the other hand, when performing a music in the song mode, under the state where the vocal harmony is set, it is desired to attach a harmony of the vocoder mode at the pitch specified by the key-on command. Furthermore, because no chord specification is made in the song mode, the chordal mode is not suitable for the vocal harmony. Therefore, when setting the vocal harmony under the song mode, mode switching of the vocal harmony must be executed manually whenever necessary.

Some commercially available recording media (floppy discs for example) recording song data representative of automatic performance signals may record settings of the vocal harmony, for example. With these recording media, however, various settings must be manually executed by users. Namely, these commercially available recording medium products differ from each other in the recording specifications for vocal harmony modes and other modes (with "TUNE 1000" for example, the vocal harmony is recorded in track 15). Therefore, the user must set which track is associated with which mode for the music performance processing according to each particular recording medium product to be used. If the user does not know the contents (corresponding tracks) of the data specifications corresponding to a particular recording medium product, the user may make erroneous settings, thereby failing to make an actually desired music performance.

SUMMARY OF THE INVENTION

It is therefore an object of the present invention to provide a music apparatus capable of generating a harmony voice by use of an external sound such as user's voice. The music apparatus according to the invention allows any users unfamiliar with harmony setting to make sufficient music performance by automatically switching the voice processing of the external sound to an appropriate mode according to a performance signal supplied from the apparatus main or a recording device coupled thereto. Furthermore, this music apparatus automatically executes the harmony setting of the voice so that appropriate harmonies are added to the music performance.

In a first aspect of the invention, the music apparatus is constructed for playing a music under different performance modes with processing of a voice signal according to a performance signal during the course of playing of a music. The music apparatus comprises an input section that provides the voice signal representative of a music sound and the performance signal indicative of how to process the voice signal in synchronization to the playing of the music, an identifying section that identifies a current performance mode under which the music is played, a processing section that processes the voice signal in accordance with the performance signal to determine a pitch of the music sound so as to adapt the pitch to the current performance mode, and an output section that outputs the processed voice signal adapted to the current performance mode during the course of the playing of the music. Further, in the first aspect, a recording medium is provided for use in a music apparatus having a processor, containing program instructions executable by the processor for causing the music apparatus to carry out a process of playing a music under different performance modes with processing of a voice signal according to a performance signal during the course of playing of a music, wherein the process comprises the steps of providing the voice signal representative of a music sound and the performance signal indicative of how to process the voice signal in synchronization to the playing of the music, identifying a current performance mode under which the music is played, processing the voice signal in accordance with the performance signal to determine a pitch of the music sound so as to adapt the pitch to the current performance mode, and outputting the processed voice signal adapted to the current performance mode during the course of the playing of the music.

In a second aspect of the invention, the music apparatus is constructed for playing a music under different performance modes with processing of a voice signal according to a performance signal during the course of playing of a music. The music apparatus comprises an input section that provides the voice signal representative of a music sound and the performance signal indicative of how to process the voice signal in synchronization to the playing of the music, an identifying section that detects whether or not chord information indicating a chord progression of the music is provided along with the performance signal for identifying a current performance mode of the playing of the music based on the detected results, a processing section that processes the voice signal in accordance with the performance signal to determine a pitch of the music sound so as to adapt the pitch to the current performance mode, and an output section that outputs the processed voice signal adapted to the current performance mode during the course of the playing of the music. In an expedient form, the identifying section detects the chord information contained in an automatic performance signal provided from the input section so as to identify the current performance mode. In another expedient form, the identifying section detects the chord information contained in a manual performance signal provided in real-time from a manual implement through the input section so as to identify the current performance mode. In a form, the input section contains a memory for storing the performance signal and the chord information.

In a third aspect of the invention, the music apparatus is constructed for playing a music according to an automatic performance signal while processing a voice signal during the course of playing of the music. The music apparatus comprises an input section that provides the voice signal representative of a music sound and the automatic performance signal together with specific information defining a specification of the music sound to be outputted, an identifying section that automatically identifies the specific information provided along with the automatic performance signal, a processing section that processes the voice signal based on the identified specific information to determine a pitch of the music sound, and an output section that outputs the processed voice signal in accordance with the specification during the course of the playing of the music.

According to the first feature of the invention, tone data indicative of harmony voices for example are generated on the basis of voice signals such as a live vocal voice signal and an instrumental voice signal, supplied from external devices such as a microphone and a tape recorder. The tone data are generated by processing the voice signals supplied from the external devices according to the performance modes.

According to the second feature of the invention, tone data indicative of a harmony voice for example are generated on the basis of voice signals supplied from the external devices. In the performance mode where an accompaniment sound signal is automatically added by chord specification (namely, the automatic accompaniment mode), the tone data with a chord-based harmony added to an input voice signal are generated for playing a music piece.

The functions based on the first and second features of the invention are applied to a particular mode as follows. Namely, either of the vocoder mode and the chordal mode in vocal harmony is automatically selected as the optimum mode according to the current performance mode. In case that chord information is detected when automatic accompaniment is on, the chordal mode in accordance with the chord information is automatically selected. In case that the chord information is not detected, the vocoder mode in accordance with note information is automatically selected. On the other hand, in the case of "song mode", switching is made to the vocoder mode.

Namely, in the music apparatus according to the invention, when the vocal harmony is set in a mode where the automatic accompaniment is performed in parallel, even if the vocoder mode is set, switching can be automatically made to the chordal mode by chord detection. In the song mode, even if the chordal mode is set, switching can be automatically made to the vocoder mode.

According to the invention, when recording vocal harmony setting data for example, write operation can be executed in wizard processing by a sequence of menu forms.

The setup data generated by user setting about harmony for example can be saved into that song data by one-touch simple operation.

Further, according to the third feature of the invention, in a music apparatus capable of generating tone data indicative of a harmony voice for example on the basis of a voice signal supplied from a first device, if tone data processing is controlled according to the performance mode by reading an automatic performance signal from a second device, particular data such as copyright for example included in the read automatic performance signal are detected. If these particular data are identified, a read track is appropriately set and the musical tone data processing is executed.

As is discussed above, some automatic performance signal stored on commercially available recording media such as floppy discs include data that correspond to a vocal harmony. According to the above-mentioned third feature, the existence and recording position of the data corresponding to the vocal harmony can be recognized by identifying the copyright information of the data. For example, in "TUNE 1000", the data corresponding to the vocal harmony are recorded on the fifth track. Therefore, the fifth track may only be referenced according to the copyright identification. If the data are stored in an SMF (Standard MIDI File) for example, a corresponding track is set by checking the copyright display for example among the meta events in the data.

Thus, according to the invention, in a music apparatus operable on the basis of an input voice for generating a harmony voice signal having a pitch different from that of the input voice and for outputting the generated voice signal, automatic switching can be executed so as to provide a harmony corresponding to the current performance situation or mode, thereby automatically providing accurate and optimal setting. The novel constitution enhances user interface, resulting in easy-to-operate music apparatuses. To be more specific, in a music apparatus capable of generating harmonies by use of externally supplied analog sounds such as user's voice, automatic setting can be executed to allow users who are unfamiliar with instrument operation and setting to play a music satisfactorily and to add appropriate harmonies.

BRIEF DESCRIPTION OF THE DRAWINGS

These and other objects of the invention will be seen by reference to the description, taken in connection with the accompanying drawings, in which.

DETAILED DESCRIPTION OF PREFERRED EMBODIMENTS

This invention will be described in further detail by way of example with reference to the accompanying drawings. It should be understood that the following embodiments are for illustrative purposes only and therefore may be changed or modified in various manners within the scope of the invention.

Figure 1:
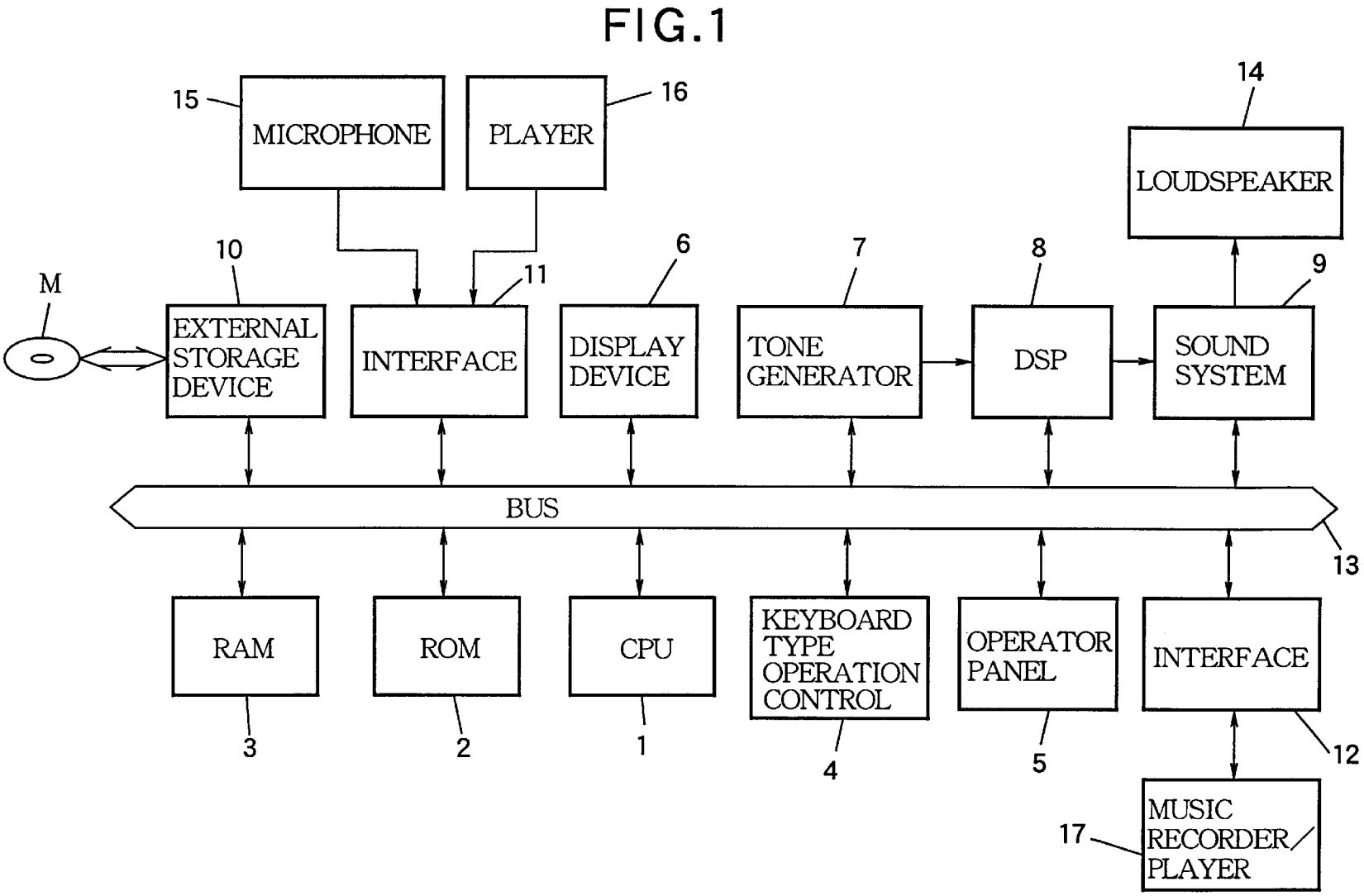
FIG. 1 is a block diagram illustrating a hardware configuration of a music apparatus practiced as one preferred embodiment of the invention.

Hardware Configuration:

Now, referring to FIG. 1, a music apparatus according to the invention comprises a CPU (Central Processing Unit) 1, a ROM (Read Only Memory) 2, a RAM (Random Access Memory) 3, a keyboard type operation control 4, an operator panel 5, a display device 6, a tone generator 7, a digital signal processor (DSP) 8, a sound system 9, an external storage device 10, an interface 11, and another interface 12. These components 1 through 12 are interconnected through a bus 13.

The CPU 1 for controlling the data processing system in its entirety executes various control operations as instructed by a predetermined program. Especially, the CPU 1 mainly executes a data processing capability to be described later. The ROM 2 stores predetermined control programs for controlling this system. These control programs include various processing operations, various tables, and various data associated with the data processing according to the invention. The RAM 3 stores data and parameters necessary for executing these processing operations. Also, the RAM 3 provides work areas for temporarily holding various data under processing.

The keyboard type operation control 4 has a keyboard for use in playing of a music piece. The operator panel 5 has manual controls for setting various modes, parameters, and operations. The display device 6 has a display monitor and various indicators. These display monitor and indicators may be arranged along with the controls on the operator panel 5. An output section composed of the tone generator 7, the DSP 8, and the sound system 9 sounds from a loudspeaker 14 tones generated on the basis of the data processed by this system.

The controls on the operator panel 5 include a style mode select button, a song mode select button, an effect mode select button, a vocal harmony setting button, a chord setting button (or dial), numeric keys for inputting style numbers for example, an automatic accompaniment on/off button, and a start/stop button. Operating the vocal harmony setting button, the user can specify "vocoder harmony" mode or "chordal harmony" mode. As required, the user can specify "automatic switching" mode for automatically switching optimum one of these two modes.

The external storage device 10 is implemented by an HDD (Hard Disk Drive) or a CD-ROM (Compact Disc ROM) drive for example. The HDD stores control programs and various data. If control programs are not stored in the ROM 2, they are stored on the HDD. The CPU 1 reads necessary control programs from the HDD and loads them into the RAM 3 to execute the same processing as that executed by loading control programs from the ROM 2. Furthermore, control programs and various data supplied on a CD-ROM for example may be read by the CD-ROM drive and stored on the HDD. In addition, control programs and various data may be downloaded from a server computer through a communication interface, not shown, into the HDD. This facilitates addition and upgrading of control programs.

In this system, the external storage device 10 includes a CD-ROM drive and an FDD (Floppy Disc Drive) for example. Therefore, song data can be read from commercially available CD-ROMs and floppy discs containing collections of song data such as automatic performance data. Music play can be made on the basis of the performance data obtained by processing the song data by this system. The obtained performance data can also be recorded on CD-ROMs and floppy discs. In addition to the CD-ROM and floppy disc, the external storage device 10 can use various forms of storage media M such as MO (Magneto Optical) discs.

The interface 11 is connected to a microphone 15 and a music player 16 such as CD player or cassette player for example. The interface 11 has a capability of inputting physical vocal voice signals and reproduced voice signals of musical instruments from these devices 15 and 16 into this data processing system. Also, the other interface 12 exchanges song data having formats different from this system with a music recorder/player 17.

Figure 2:
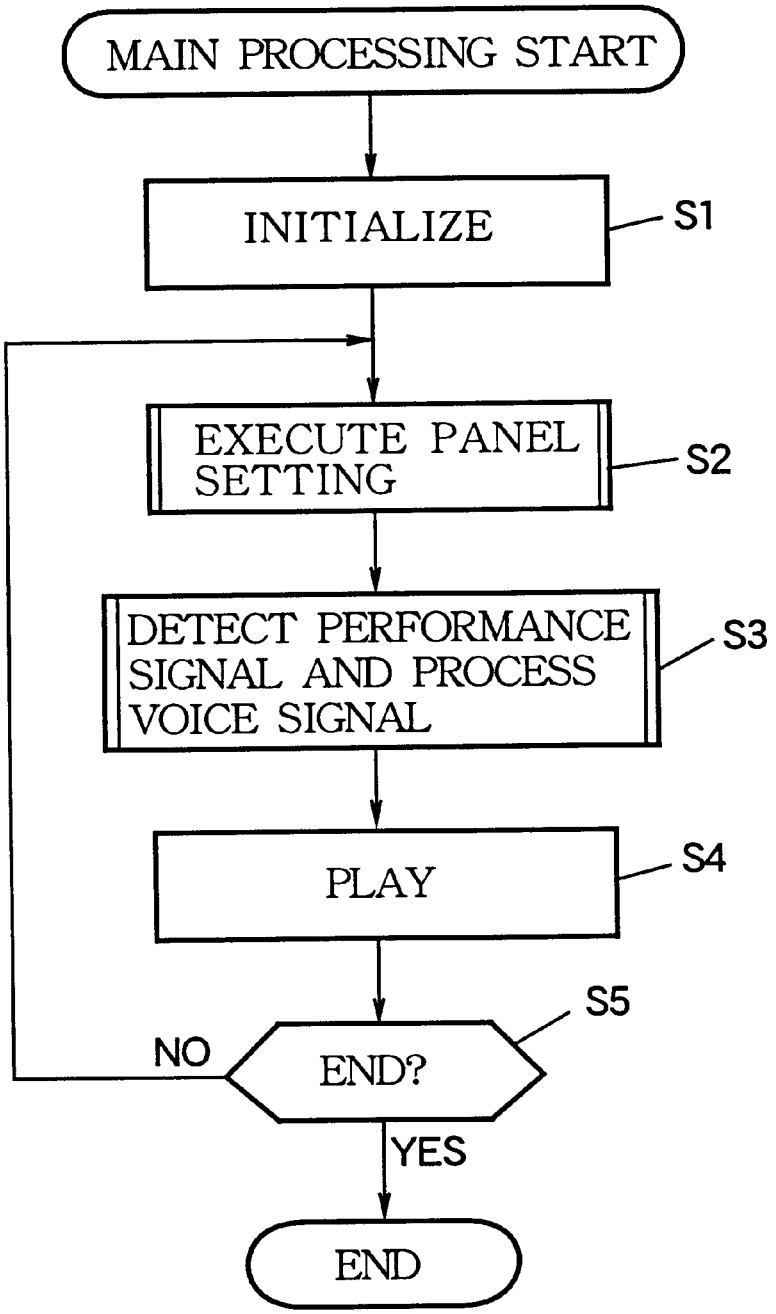
FIG. 2 is a flowchart of main processing indicative of the entire data processing according to the embodiment shown in FIG. 1.

Main Processing:

Referring to FIG. 2, there is shown in the form of a flowchart the main processing of the entire data processing practiced as one embodiment of the invention. In step S1, the system is initialized. In step S2, panel setting processing is executed to set the mode and parameter corresponding to the operation of a manual control on the operator panel 5.

In step S3, the system detects a performance signal corresponding to a key-on operation on the keyboard type operation control 4, an automatic performance signal (song data) read from the external storage device 10, a voice signal inputted from the microphone 15 or a reproduced voice signal inputted from the player 16, or a reproduced voice signal inputted from the music recorder/player 17. According to the mode and parameter set from the operator panel 5, by executing performance condition switching as required, appropriate tone data are generated.

In step S4, a music piece is played on the basis of the generated tone data and the performance signal. The music sounds are outputted from the output section composed of the devices 7 through 9 via the loudspeaker 14. Until a command to end the main processing comes in step S5, the processing operations of steps S2 through S4 are repeated.

Thus, in the system according to the invention, as outlined in the main processing shown in FIG. 2, the modes and parameters associated with the automatic accompaniment capability and the vocal harmony capability are set in advance by operating the corresponding controls on the operator panel 5. Then, when a performance signal corresponding to a key-on operation by the keyboard type operation control 4, an automatic performance signal read from the external storage device 10, a voice signal inputted from the microphone 15, or another voice signal supplied from the music player 16 is inputted, the tone data indicative of vocal harmony are generated according to the mode and parameter set from the operator panel 5. At this moment, the current performance state is determined by presence or absence of chord specification information inputted along with the performance signal or the automatic performance signal, thereby automatically executing the vocal harmony mode switching.

Figure 3:
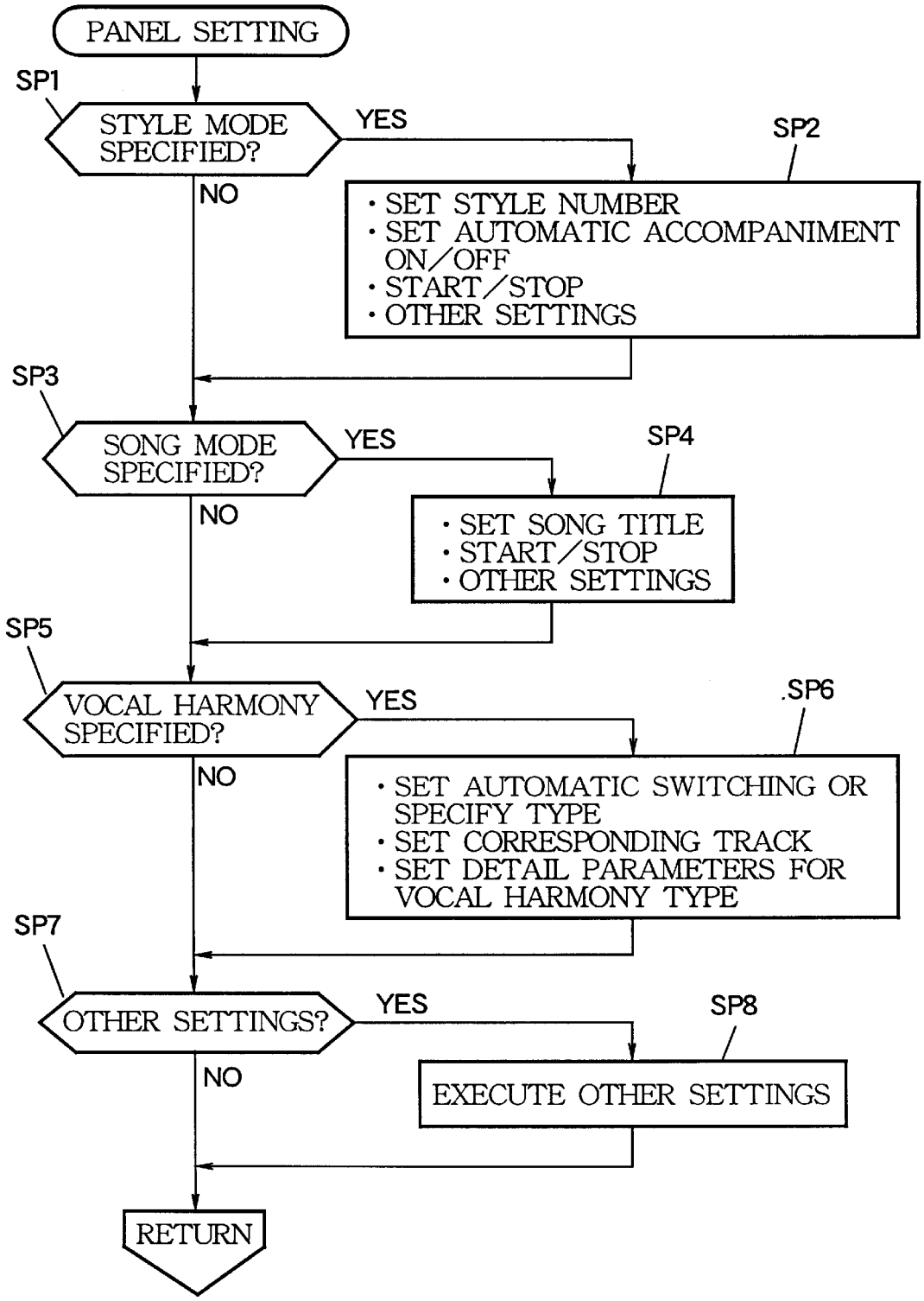
FIG. 3 is a diagram illustrating a panel setting processing routine according to the embodiment shown in FIG. 1.

Panel Setting Processing:

Referring to FIG. 3, there is shown one example of the panel setting processing routine of step S2 shown in FIG. 1. In step SP1, it is determined whether "style mode" is specified. If "style mode" has been specified by pressing the style mode select button on the operator panel 5, control is passed to step SP2; otherwise, control is passed to step SP3. In step SP2, according to the operation states of buttons and keys on the operator panel 5 executed for the "style mode" specification, a style number indicative of various performance styles (for example, 8-beat pops and dance pops) are set, automatic accompaniment on/off is set, start/stop is set, and other settings are executed.

In step SP3, it is determined whether "song mode" is specified. If "song mode" has been specified by pressing the song mode select button on the operator panel 5, control is passed to step SP4; otherwise, control is passed to step SP5. In step SP4, according to the operation states of buttons and keys on the operator panel 5 executed for the "song mode" specification, a song title is set, start/stop is set, and other settings are executed. In this case, the song is selectively specified from among the song titles recorded on the floppy disc or else of the external storage device 10 for example. For such a floppy disc, a commercially available data disc may be used.

In step SP5, it is determined whether "vocal harmony" is specified. If "vocal harmony" has been specified by pressing the vocal harmony select button on the operator panel 5, control is passed to step SP6; otherwise, control is passed to step SP7. In step SP6, according to the operation states of buttons and keys on the operator panel 5 executed for "vocal harmony" specification, "automatic switching capability" may be set to automatically switch between vocoder harmony and chordal harmony Otherwise, the harmony type is fixed to one of the vocoder harmony and the chordal harmony. In addition, in step SP6, according to the product type of the recording medium in terms of the song data recording specifications recorded on the floppy disc of the external storage device 10 (for example, identification of copyright by copyright display in SMF meta event), a corresponding vocal harmony recorded track is searched and set. Further, in step SP6, on the basis of the operation of buttons and keys on the operator panel 5, detail parameters associated with the type of vocal harmony (namely, vocoder harmony or chordal harmony) are set.

In step SP7, whether settings other than above have been made or not is determined. If the decision is yes, control is passed to step SP8, in which the processing for other settings is executed. Control is then passed to the performance signal detection and voice signal processing routine of step S3 of the main process (FIG. 2).

Figure 4:
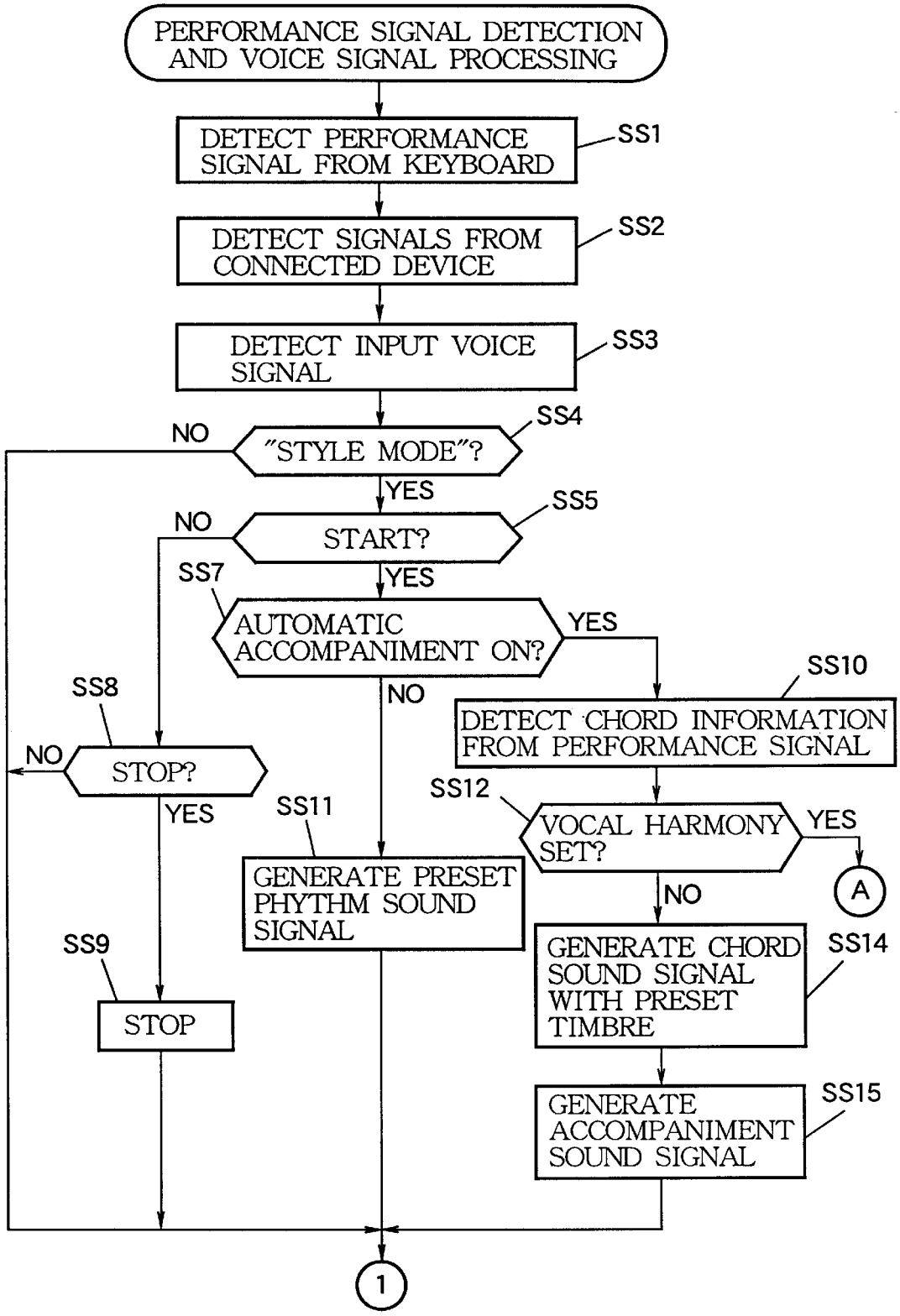
FIG. 4 is a diagram illustrating a first portion of performance signal detection and voice signal processing routines according to the embodiment shown in FIG. 1.
Figure 5:
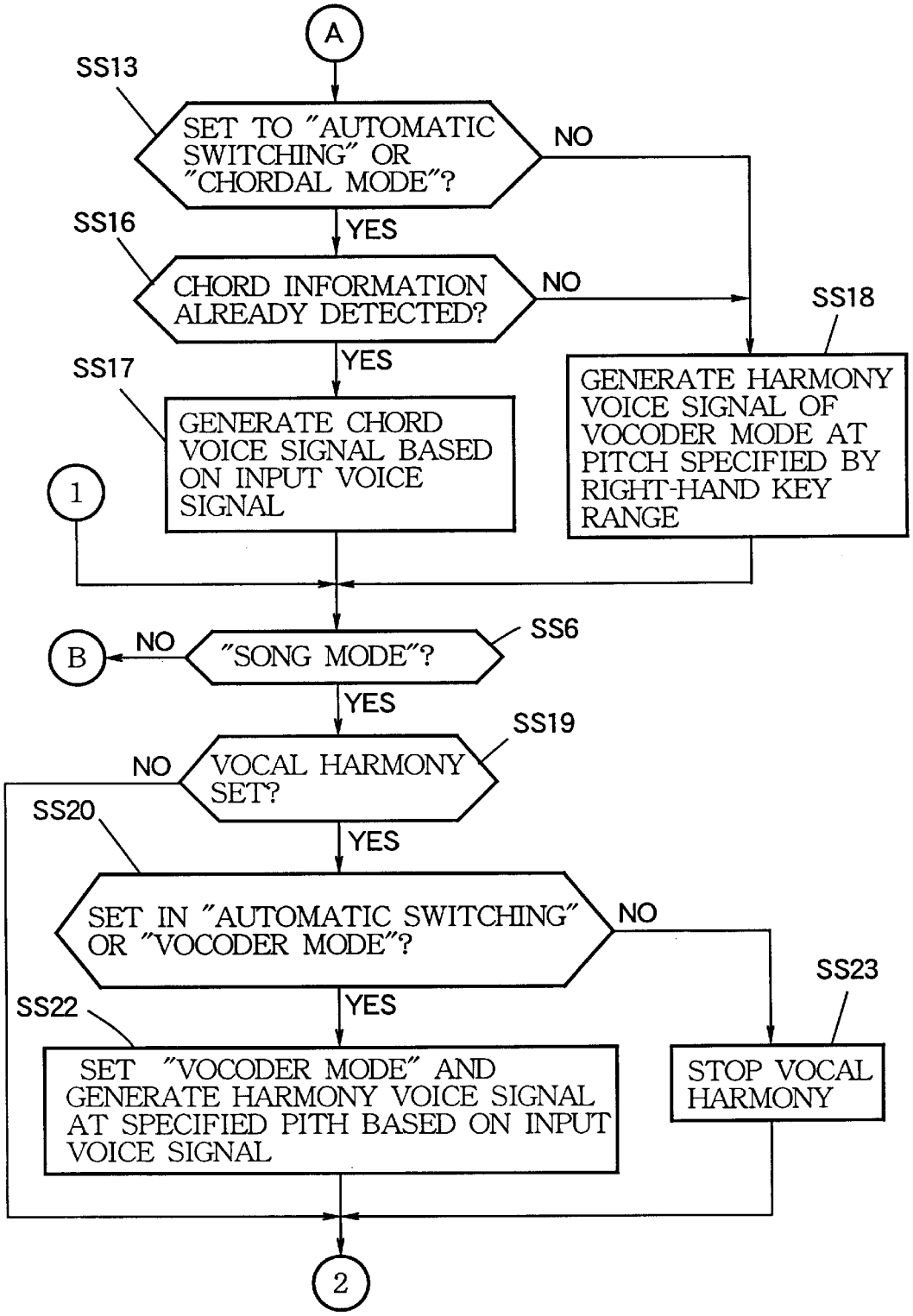
FIG. 5 is a diagram illustrating a second portion of the performance signal detection and voice signal processing routines according to the embodiment shown in FIG. 1.
Figure 6:
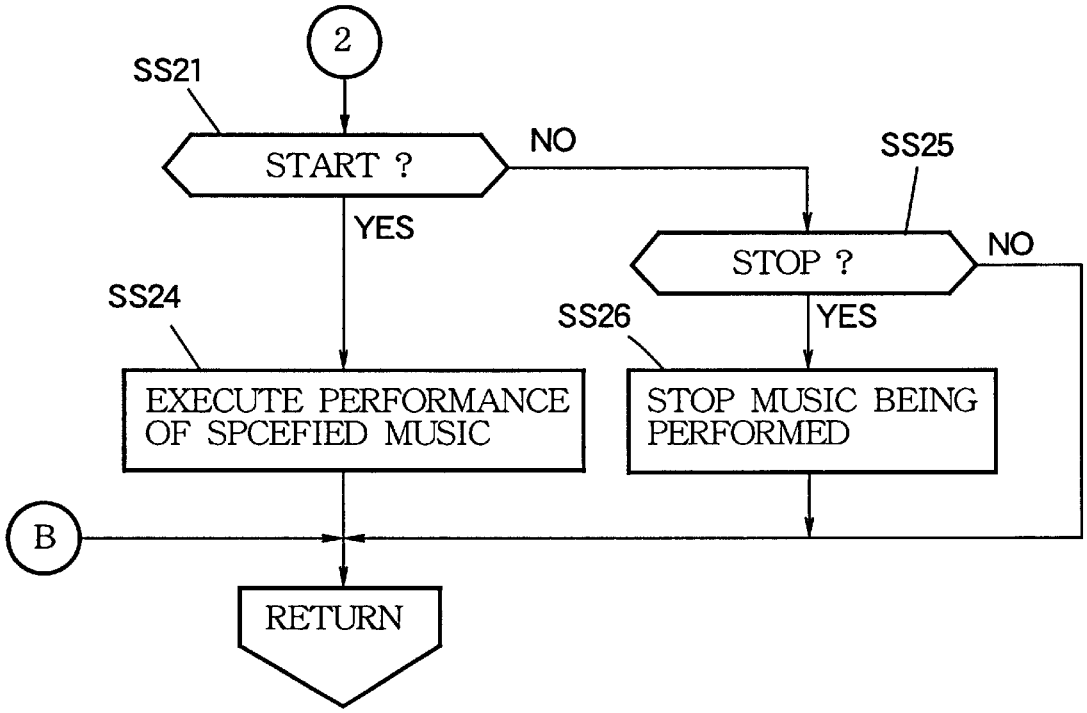
FIG. 6 is a diagram illustrating a third portion of the performance signal detection and voice signal processing routines according to the embodiment shown in FIG. 1.

Performance Signal Detection and Voice Signal Processing:

Referring to FIGS. 4 through 6, there is shown one example of the performance signal detection and processing routine of step S3 shown in FIG. 1. In step SS1, the system detects a performance signal commanding a note-on (key-on) on the basis of the operation of a performance operation control such as the keyboard from the keyboard type operation control. In step SS2, the system detects another performance signal read from the external storage device 10 and performance signals from the music players 16 and 17 connected to the interfaces 11 and 12, respectively.

In step SS3, a voice signal inputted from the microphone is detected.

Style Mode Processing:

In step SS4, it is determined whether "style mode" is currently set or not. If the decision is yes, control is passed to step SS5; otherwise, control is passed to the "song mode" processing in step SS6 (FIG. 5) and subsequent steps. If a start command is found in step SS5, control is then passed to step SS7. If the start command is not found, then control is passed to step SS8. If a stop command is found, stop processing is executed in step SS9 and then control is returned to step SS6.

In step SS7, it is determined whether "automatic accompaniment" is currently set or not. If the decision is yes, control is passed to step SS10; otherwise, control is passed to step SS11, in which processing for generating a preset rhythm signal is executed, upon which control is passed to step SS6 (FIG. 5). In the automatic accompaniment mode, "chordal harmony mode" is basically suitable for vocal harmony, so that control is passed to step SS10. In step SS10, information concerning chord specification is detected from the performance signal supplied from the keyboard type operation control 4 in step SS1. Then control is passed to step SS12. This chord specification can be easily inputted by specifying a predetermined chord setting mode (for example, single finger mode) by operating the chord setting button (or dial) and then by operating a predetermined key (for example, in the single finger mode, a key corresponding to a root of a specific chord, for example) of an accompaniment key region (leftmost key region) on the keyboard type operation control 4.

In step SS12, it is determined whether "vocal harmony" is set or not. If the decision is yes, control is passed to step SS13 (FIG. 5); otherwise, a chord tone signal is generated on the basis of a preset timbre in step SS14. Then, in step SS15, processing for generating accompaniment tone data is executed, upon which control is passed to step SS6 (FIG. 5).

In step SS13, it is determined whether "automatic switching capability" is set by the specification of "automatic switching" mode for vocal harmony type or whether the vocal harmony type is set to "chordal harmony". If the decision is yes, control is passed to step SS16. In step SS16, it is determined whether the chord specification has already been detected at step SS10. If the decision is yes, then, in step SS17, a chord voice signal of a provisionally specified pitch is generated on the basis of the voice signal inputted from the microphone 15 in step SS3, upon which control is passed to step SS6. Therefore, when the automatic accompaniment has been set, the pitch of the input voice is altered according to the chord specification in real-time and the altered pitch is added as a harmony.

If the decision is no in step SS13, namely, the "vocoder harmony" mode is set, or if the decision is no in step SS16, namely no chord specification has been detected, processing for generating a harmony voice signal of the "vocoder harmony" mode is carried out for sounding a harmony voice processed from the voice inputted from the microphone 15 at the pitch specified by the right-hand key region of the keyboard type operation control 4 in step SS18. Then, control is passed to step SS6.

Song Mode Processing:

In step SS6, it is determined whether "song mode" is currently set or not. If the decision is yes, control is passed to step SS19; otherwise, control is passed to the music play process of step S4 of the main processing (FIG. 2). In step SS19, it is determined whether "vocal harmony" is set or not. If the decision is yes, control is passed to step SS20; otherwise control is passed to step SS21 (FIG. 6).

In step SS20, it is determined whether "automatic switching capability" is set for the vocal harmony type or whether the vocal harmony type is set to "vocoder harmony". If the decision is yes, control is passed to step SS22, in which "vocoder harmony" is used as the vocal harmony and a harmony voice signal of specified pitch is generated on the basis of the voice signal supplied from the microphone 15. Then, control is passed to step SS21 (FIG. 6).

Thus, in the song mode, the pitch of the voice signal supplied from the microphone 15 is altered on the basis of the pitch data of the performance signal specified by operating the keyboard of the keyboard type operation control 4 or the performance signal read from the external storage device 10. Alternatively, the vocoder harmony voice signal based on the above-mentioned pitch data may be added to the original input voice signal to output the resultant sounds from the output section composed of the devices 7 through 9. Consequently, a sung voice is heard as matching the pitch. In this case, for actual use, processing for lowering or not outputting the level of the original input voice signal may be executed, thereby outputting only the harmony voice signal for playing the music. Further, a gender capability of altering an input voice to a voice of opposite gender may be applied to the above-mentioned input voice, making a song sung by a male to hear like female song or vice versa.

If the decision is no in step SS20, namely the "chordal harmony" mode is not set, then processing for stopping the vocal harmony capability is executed in step SS23, upon which control is passed to step SS21 (FIG. 6).

In step SS21, if a start command is found, control is passed to step SS24, in which processing for outputting the processed data of specified song is executed. Then, control is passed to the music play process of step S4 of the main processing (FIG. 2). If a start command is not found and if a stop command is found in step SS25, processing for stopping the music play is executed in step SS26. Then control is returned to step S4 of the main processing.

Referring back again to FIG. 1, the inventive music apparatus is constructed for playing a music under different performance modes with processing of a voice signal according to a performance signal during the course of playing of a music. In the music apparatus, an input section including the interfaces 11 and 12 provides the voice signal representative of a music sound and the performance signal indicative of how to process the voice signal in synchronization to the playing of the music. An identifying section composed of the CPU 1 identifies a current performance mode under which the music is played. A processing section composed also of the CPU 1 processes the voice signal in accordance with the performance signal to determine a pitch of the music sound so as to adapt the pitch to the current performance mode. An output section including the loudspeaker 14 outputs the processed voice signal adapted to the current performance mode during the course of the playing of the music. In detail, the identifying section discriminates between a style performance mode which turns on an automatic accompaniment of the music and a song performance mode which turns off the automatic accompaniment, and the processing section operates when the identifying section identifies that the current performance mode is the style performance mode for processing the voice signal to create a chordal harmony of the music sound in matching with the automatic accompaniment, and otherwise operates when the identifying section identifies that the current performance mode is the song performance mode for processing the voice signal to create a vocoder harmony of the music sound. Further, the identifying section identifies that the current performance mode is the style performance mode if the performance signal includes information concerning a chord progression of the automatic accompaniment, and otherwise identifies that the current performance mode is the song performance mode if the performance signal excludes information concerning a chord progression of the automatic accompaniment. In one form, the input section provides the voice signal inputted from the microphone 15 and representative of a vocal music sound which is physically voiced during the course of the playing of the music, and provides the performance signal which is fed from a manual implement such as the keyboard 4 during the course of the playing of the music. In another form, the input section provides the voice signal representative of a vocal music sound which is physically voiced during the course of the playing of the music, and provides the performance signal which is reproduced from a memory medium of the external storage device, the music player 16 or the recorder/player 17 during the course of the playing of the music. In such a case, the input section analyzes contents of the memory medium so as to automatically retrieve therefrom the performance signal used to process the voice signal.

Further, the machine readable medium M is provided for use in the music apparatus having the CPU 1, containing program instructions executable by the CPU 1 for causing the music apparatus to carry out a process of playing a music under different performance modes with processing of a voice signal according to a performance signal during the course of playing of a music. The process is carried out by the steps of providing the voice signal representative of a music sound and the performance signal indicative of how to process the voice signal in synchronization to the playing of the music, identifying a current performance mode under which the music is played, processing the voice signal in accordance with the performance signal to determine a pitch of the music sound so as to adapt the pitch to the current performance mode, and outputting the processed voice signal adapted to the current performance mode during the course of the playing of the music.

As described and according to the invention, in a music apparatus capable of generating harmony voices by use of external voices such as user's voice for example, switching is automatically made to a vocal harmony mode in which signal processing for the external voice is applied according to a performance signal supplied from the apparatus main or a recording device connected thereto. This novel constitution allows users who are unfamiliar with harmony setting to make a satisfactory music play. Furthermore, the above-mentioned novel constitution allows users to execute automatic harmony setting so that appropriate harmonies are added.

While the preferred embodiments of the present invention have been described using specific terms, such description is for illustrative purposes only, and it is to be understood that changes and variations may be made without departing from the spirit or scope of the appended claims.

What is claimed is:

1. A music apparatus for playing a music under different performance modes with processing of a voice signal according to a performance signal during the course of playing of a music, the music apparatus comprising:

an input section that provides the voice signal representative of a music sound and the performance signal indicative of how to process the voice signal in synchronization to the playing of the music;

an identifying section that identifies a current performance mode under which the music is played;

a processing section that processes the voice signal in accordance with the performance signal to determine a pitch of the music sound so as to adapt the pitch to the current performance mode; and an output section that outputs the processed voice signal adapted to the current performance mode during the course of the playing of the music.

2. The music apparatus according to claim 1, wherein the identifying section discriminates between a style performance mode which turns on an automatic accompaniment of the music and a song performance mode which turns off the automatic accompaniment, and wherein the processing section operates when the identifying section identifies that the current performance mode is the style performance mode for processing the voice signal to create a chordal harmony of the music sound in matching with the automatic accompaniment, and otherwise operates when the identifying section identifies that the current performance mode is the song performance mode for processing the voice signal to create a vocoder harmony of the music sound.

3. The music apparatus according to claim 2, wherein the identifying section identifies that the current performance mode is the style performance mode if the performance signal includes information concerning a chord progression of the automatic accompaniment, and otherwise identifies that the current performance mode is the song performance mode if the performance signal excludes information concerning a chord progression of the automatic accompaniment.

4. The music apparatus according to claim 1, wherein the input section provides the voice signal representative of a vocal music sound which is physically voiced during the course of the playing of the music, and provides the performance signal which is fed from a manual implement during the course of the playing of the music.

5. The music apparatus according to claim 1, wherein the input section provides the voice signal representative of a vocal music sound which is physically voiced during the course of the playing of the music, and provides the performance signal which is reproduced from a memory medium during the course of the playing of the music.

6. The music apparatus according to claim 5, wherein the input section analyzes contents of the memory medium so as to automatically retrieve therefrom the performance signal used to process the voice signal.

7. A music apparatus for playing a music under different performance modes with processing of a voice signal according to a performance signal during the course of playing of a music, the music apparatus comprising:

an input section that provides the voice signal representative of a music sound, and provides the performance signal indicative of how to process the voice signal in synchronization to the playing of the music;

an identifying section that detects whether or not chord information indicating a chord progression of the music is provided along with the performance signal, for identifying a current performance mode of the playing of the music based on the detected results;

a processing section that processes the voice signal in accordance with the performance signal to determine a pitch of the music sound so as to adapt the pitch to the current performance mode; and an output section that outputs the processed voice signal adapted to the current performance mode during the course of the playing of the music.

8. The music apparatus according to claim 7, wherein the identifying section detects the chord information contained in an automatic performance signal provided from the input section so as to identify the current performance mode.

9. The music apparatus according to claim 7, wherein the identifying section detects the chord information contained in a manual performance signal provided in real-time from a manual implement through the input section so as to identify the current performance mode.

10. The music apparatus according to claim 7, wherein the input section contains a memory for storing the performance signal and the chord information.

11. A music apparatus for playing a music according to an automatic performance signal while processing a voice signal during the course of playing of the music, the music apparatus comprising:

an input section that provides the voice signal representative of a music sound, and provides the automatic performance signal together with specific information defining a specification of the music sound to be outputted;

an identifying section that automatically identifies the specific information provided along with the automatic performance signal;

a processing section that processes the voice signal based on the identified specific information to determine a pitch of the music sound; and an output section that outputs the processed voice signal in accordance with the specification during the course of the playing of the music.

12. A method of playing a music under different performance modes with processing of a voice signal according to a performance signal during the course of playing of a music, the method comprising the steps of:

providing the voice signal representative of a music sound and the performance signal indicative of how to process the voice signal in synchronization to the playing of the music;

identifying a current performance mode under which the music is played;

processing the voice signal in accordance with the performance signal to determine a pitch of the music sound so as to adapt the pitch to the current performance mode; and outputting the processed voice signal adapted to the current performance mode during the course of the playing of the music.

13. A method of playing a music under different performance modes with processing of a voice signal according to a performance signal during the course of playing of a music, the method comprising the steps of:

providing the voice signal representative of a music sound and the performance signal indicative of how to process the voice signal in synchronization to the playing of the music;

detecting whether or not chord information indicating a chord progression of the music is provided along with the performance signal so as to identify a current performance mode of the playing of the music based on the detected results;

processing the voice signal in accordance with the performance signal to determine a pitch of the music sound so as to adapt the pitch to the current performance mode; and outputting the processed voice signal adapted to the current performance mode during the course of the playing of the music.

14. A method of playing a music according to an automatic performance signal while processing a voice signal during the course of playing of the music, the method comprising the steps of:

providing the voice signal representative of a music sound and the automatic performance signal together with specific information defining a specification of the music sound to be outputted;

automatically identifying the specific information provided along with the automatic performance signal;

processing the voice signal based on the identified specific information to determine a pitch of the music sound; and outputting the processed voice signal in accordance with the specification during the course of the playing of the music.

15. A medium for use in a music apparatus having a processor, containing program instructions executable by the processor for causing the music apparatus to carry out a process of playing a music under different performance modes with processing of a voice signal according to a performance signal during the course of playing of a music, wherein the process comprises the steps of:

providing the voice signal representative of a music sound and the performance signal indicative of how to process the voice signal in synchronization to the playing of the music;

identifying a current performance mode under which the music is played;

processing the voice signal in accordance with the performance signal to determine a pitch of the music sound so as to adapt the pitch to the current performance mode; and outputting the processed voice signal adapted to the current performance mode during the course of the playing of the music.

16. A medium for use in a music apparatus having a processor, containing program instructions executable by the processor for causing the music apparatus to carry out a process of playing a music under different performance modes with processing of a voice signal according to a performance signal during the course of playing of a music, wherein the process comprises the steps of:

providing the voice signal representative of a music sound and the performance signal indicative of how to process the voice signal in synchronization to the playing of the music;

detecting whether or not chord information indicating a chord progression of the music is provided along with the performance signal so as to identify a current performance mode of the playing of the music based on the detected results;

processing the voice signal in accordance with the performance signal to determine a pitch of the music sound so as to adapt the pitch to the current performance mode; and outputting the processed voice signal adapted to the current performance mode during the course of the playing of the music.

17. A medium for use in a music apparatus having a processor, containing program instructions executable by the processor for causing the music apparatus to carry out a process of playing a music according to an automatic performance signal while processing a voice signal during the course of playing of the music, wherein the process comprises the steps of:

providing the voice signal representative of a music sound and the automatic performance signal together with specific information defining a specification of the music sound to be outputted;

automatically identifying the specific information provided along with the automatic performance signal;

processing the voice signal based on the identified specific information to determine a pitch of the music sound; and outputting the processed voice signal in accordance with the specification during the course of the playing of the music.

* * * * *